US005342212A

United States Patent [19]

Francis

[11] Patent Number: 5,342,212

[45] Date of Patent: Aug. 30, 1994

[54] ELECTRICAL PLUG PROTECTIVE APPARATUS

[76] Inventor: Joseph N. Francis, 2051 Midnight St., Port Charlotte, Fla. 33948

[21] Appl. No.: 55,275

[22] Filed: May 3, 1993

[51] Int. Cl.[5] ..... H01R 13/44

[52] U.S. Cl. ..... 439/149; 437/369

[58] Field of Search ..... 439/147, 149, 367–371

[56] References Cited

U.S. PATENT DOCUMENTS

| | | | |
|---|---|---|---|
| 4,438,995 | 3/1984 | Fisher et al. | 439/147 |
| 4,718,856 | 1/1988 | Pinkerton et al. | 439/147 |
| 4,940,424 | 7/1990 | Odbert | 439/369 |
| 5,217,387 | 6/1993 | Huw et al. | 439/369 X |

*Primary Examiner*—Eugene F. Desmond

[57] ABSTRACT

A new and improved electrical plug protective apparatus includes a first funnel-shaped protective member for an electrical plug. The first funnel-shaped protective member includes a cone-shaped portion and a tubular portion connected to the cone-shaped portion. The cone-shaped portion protects the electrical plug. The tubular portion protects a region of a conductor that is connected to a backside of the electrical plug. The protective member includes a separation assembly, extending longitudinally along both the cone-shaped portion and the tubular portion, for permitting the protective member to be opened for applying the protective member to the electrical plug or for removing the protective member from the electrical plug. The separation assembly may include complementary tongue and groove connectors that snap together and a hinge assembly located on the first funnel-shaped protective member in a location opposite to the complementary tongue and groove connectors. The hinge assembly may include a living hinge. A door may be located adjacent to the first aperture of the cone-shaped portion. The door may include small apertures for receiving prongs of the electrical plug. The door may be attached to the cone-shaped portion by a hinge and a clip. A prong cover, connected to the first funnel-shaped protective member, may be used for covering prongs of the electrical plug. The prong cover may include lock apertures for receiving the hinge and the clip when the prong cover is used to cover the prongs.

10 Claims, 4 Drawing Sheets

ELECTRICAL PLUG PROTECTIVE APPARATUS

BACKGROUND OF THE INVENTION

1. Field of the Invention

The present invention relates generally to protective devices for electrical plugs, and more particularly, to an electrical plug protective device, especially adapted for protecting a plug and a conductor connected to the plug.

2. Description of the Prior Art

When electrical plugs are in good working condition and treated well they provide a reasonable degree of safety from electric shock or short circuiting. However, over time, with extended use, parts of plugs or the conductors connected to the plugs often exhibit signs of wear that may ultimately prove hazardous. More specifically, a connection between a conductor and the backside of a plug is a location where extensive wear may be especially hazardous. As the plug is used over time, the connection between the conductor and the backside of the plug is particularly susceptible to fraying. This is so because this region of the conductor is often subjected to frequent and above normal stresses. When this region of the conductor weakens or frays, the conductor is especially susceptible to short circuiting or breaking. In this respect, it would be desirable if an electrical plug protective device were provided that gave special protection to the region of the conductor that is connected to the backside of the plug.

A number of electrical plug protective devices are disclosed in the prior art. Some of the prior art devices are disclosed in the following U.S. Pat. Nos.: 3,452,321; 3,763,457; 4,305,634; 4,676,570; and 4,944,685. More particularly, U.S. Pat. No. 3,452,321 discloses a protective cover for both male and female connector portions of an electrical connection. One protective structure is associated with the male portion, and a second protective structure is associated with the female portion. When the prongs of a plug are inserted into a wall outlet, the wall and the wall outlet itself provide a degree of protection for the electrical plug connected to the wall outlet. Therefore, under these circumstances, a separate protective portion for the wall outlet is unnecessary. In this respect, it would be desirable if an electrical plug protective device were provided that precluded a separate protective portion for the female connector portion when the male connector portion is connected to the female connector portion.

U. S. Pat. No. 3,763,457 discloses a plug guard for a plug that is not in use. The plug guard in this patent is also used to prevent use of the plug. However, this device cannot be used to protect the plug when the plug is in use in a wall outlet. In this respect, it would be desirable if an electrical plug protective device were provided that can be used on an electrical plug when the plug is connected to a wall outlet.

U.S. Pat. No. 4,305,634 discloses a disk-shaped electrical plug protective device that fits over the prongs of a plug and skews the prongs off center. The disk-shaped device prevents contact of a person's fingers with prongs of the plug when the plug is not fully inserted into the wall outlet. This skewing of the prongs can lead to premature wear and failure of the prongs. In this respect, it would be desirable if an electrical plug protective device were provided which protected an electrical plug without skewing the prongs of the plug.

U.S. Pat. No. 4,944,685 is like U.S. Pat. No. 3,452,321 with respect to a disclosure of a protective cover for both male and female connector portions of an electrical connection. In this respect, the 4,944,685 and the 3,452,321 patents have similar problems.

U.S. Pat. No. 4,676,570 may be of interest for its disclosure of a cover for a wall outlet socket.

Although the prior art described above has the deficiencies described above, the prior art does teach some valuable lessons. The prior art teaches that there are advantages to protecting an electrical plug from damage when it is not in use. There are also advantages in guarding an electrical plug so as to prevent unauthorized use. In this respect, it would be desirable if an electrical plug protective device were provided that also protected an electrical plug from damage when not in use and also prevented unauthorized use. Unauthorized use can be very dangerous, especially when children attempt to use dangerous equipment.

Some of the prior art electrical plug protective devices are difficult to install and may damage the plug during installation. In this respect, it would be desirable if an electrical plug protective device were provided that were easy to install and that did not subject the plug to damage during installation.

Aside from the desirable feature of easy installation, it would also be desirable if an electrical plug protective device were provided that were easy to remove and place on another plug.

Moreover, it would also be desirable if the portion of the protective device that protected the plug from damage when not in use and from unauthorized use could be easily installed or removed from an electrical plug protective device at the option of the user.

An electrical wall outlet generally has a plurality of sockets. Moreover, many times, a multiple socket device will be plugged into a wall socket to expand the number of available sockets. When a plurality of devices are plugged into a plurality of sockets, it is often very confusing as to which plug corresponds to which device. It is often difficult and time consuming to trace conductors back from the wall socket to the particular devices. It may also be very inconvenient to remove plugs one by one, as by trial and error, to identify which plug corresponds to which device. In this respect, it would be desirable if an electrical plug protective device were provided that provided a means for identifying which plug is associated with which device.

In view of the desirable features of an electrical plug protective device mentioned above for a plug that is installed in a wall outlet, it would also be desirable if respective applicable desirable features could also be used with cords having complementary male plugs and female sockets.

Thus, while the foregoing body of prior art indicates it to be well known to use protectors for electrical plugs, the prior art described above does not teach or suggest an electrical plug protective apparatus which has the following combination of desirable features: (1) gives special protection to the region of the conductor that is connected to the backside of the plug; (2) precludes the need for a separate protective portion for the female connector portion when the male connector portion is connected to the female connector portion; (3) can be used on an electrical plug when the plug is connected to a wall outlet; (4) protects an electrical plug without skewing the prongs of the plug; (5) protects an electrical plug from damage when not in use and also prevents unauthorized use; (6) is easy to install and does not subject the plug to damage during installation; (7) is easy to remove from one plug and place on another plug; (8) were provides means for identifying which plug is associated with which device; (9) the portion of the protective device that protects the plug from damage when not in use and from unauthorized use is easily installed or removed from an electrical plug protective device at the option of the user; and (10) can be used with cords having complementary male plugs and female sockets. The foregoing desired characteristics are provided by the unique electrical plug protective apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved electrical plug protective apparatus which includes a first funnel-shaped protective member for an electrical plug. The first funnel-shaped protective member includes a cone-shaped portion and a tubular portion connected to the cone-shaped portion. The cone-shaped portion protects the electrical plug. The tubular portion protects a region of a conductor that is connected to a backside of the electrical plug. The protective member includes a separation assembly, extending longitudinally along the cone-shaped portion and the tubular portion, for permitting the protective member to be opened for applying the protective member to the electrical plug and the conductor or for removing the protective member from the electrical plug and the conductor. The separation assembly may include complementary tongue and groove connectors that snap together and a hinge assembly located on the first funnel-shaped protective member in a location opposite to the complementary tongue and groove connectors. The hinge assembly may include a living hinge.

The cone-shaped portion of the first funnel-shaped protective member includes a first aperture at one end of the cone-shaped portion, and the tubular portion includes a second aperture at one end of the tubular portion.

A door may be located adjacent to the first aperture of the cone-shaped portion. The door may include small apertures for receiving prongs of the electrical plug. The door may be attached to the cone-shaped portion by a hinge and a clip. The hinge and the clip project vertically to a side of the door.

The electrical plug protective apparatus of the invention may also include a prong cover, connected to the first funnel-shaped protective member, for covering prongs of the electrical plug. The prong cover may include lock apertures for receiving the hinge and the clip when the prong cover is used to cover the prongs. In this way, the prong cover is secured to the first funnel-shaped protective member.

In accordance with another aspect of the invention, the electrical plug protective apparatus may include a cone-shaped portion which includes a transparent window permitting identification of an electrical plug retained in the first funnel-shaped protective member. A quantity of colored plastic material contained within the cone-shaped portion and visible through the transparent window permitting identification of an electrical plug retained in the first funnel-shaped protective member. The conductor leading to the electrical plug can also be color coded, if desired.

In accordance with another aspect of the invention, the electrical plug protective apparatus wherein the cone shaped portion of the first funnel-shaped protective member receives an electrical plug and includes a first aperture at one end of the cone-shaped portion. The first aperture includes an inner diameter having an inner diameter length. A second funnel-shaped protective member is used to protect an electrical socket on a conductor. The second funnel-shaped protective member includes a cone-shaped portion and a tubular portion connected to the cone-shaped portion. The second cone-shaped portion protects the electrical socket. The second tubular portion for protects a region of the conductor that is connected to a backside of the electrical socket.

The second funnel-shaped protective member includes a separation assembly which extends longitudinally along the cone-shaped portion and the tubular portion. The separation assembly permits the second funnel-shaped protective member to be opened for applying the second funnel-shaped protective member to the electrical socket and the adjacent conductor or for removing the second funnel-shaped protective member from the electrical socket and the conductor. The cone-shaped portion of the second funnel-shaped protective member includes a first aperture at one end of the cone-shaped portion. The tubular portion includes a second aperture at one end of the tubular portion. The first aperture includes an inner diameter having an inner diameter length, and wherein the inner diameter length of the first aperture of the second funnel-shaped protective member is greater than the inner diameter length of the first funnel-shaped protective member such that the first funnel-shaped protective member is nested into the second funnel-shaped protective member.

The first funnel-shaped protective member and the second funnel-shaped protective member include complimentary projections and projection-receiving aperture connectors for connecting the respective first and second funnel-shaped protective members together.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least four preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved electrical plug protective apparatus which has all of the advantages of the prior art and none of the disadvantages.

It is another object of the present invention to provide a new and improved electrical plug protective apparatus which may be easily and efficiently manufactured and marketed.

It is a further object of the present invention to provide a new and improved electrical plug protective apparatus which is of durable and reliable construction.

An even further object of the present invention is to provide a new and improved electrical plug protective apparatus which is susceptible of a low cost of manufacture with regard to both materials and labor, and which accordingly is then susceptible of low prices of sale to the consuming public, thereby making such electrical plug protective apparatus available to the buying public.

Still yet a further object of the present invention is to provide a new and improved electrical plug protective apparatus that gives special protection to the region of the conductor that is connected to the backside of the plug.

Still another object of the present invention is to provide a new and improved electrical plug protective apparatus that precludes the need for a separate protective portion for the female connector portion when the male connector portion is connected to the female connector portion.

Yet another object of the present invention is to provide a new and improved electrical plug protective apparatus that can be used on an electrical plug when the plug is connected to a wall outlet.

Even another object of the present invention is to provide a new and improved electrical plug protective apparatus which protects an electrical plug without skewing the prongs of the plug.

Still a further object of the present invention is to provide a new and improved electrical plug protective apparatus that also protects an electrical plug from damage when not in use and also prevents unauthorized use.

Yet another object of the present invention is to provide a new and improved electrical plug protective apparatus that is easy to install and that does not subject the plug to damage during installation.

Still another object of the present invention is to provide a new and improved electrical plug protective apparatus that is easy to remove from one plug and place on another plug.

Yet another object of the present invention is to provide a new and improved electrical plug protective apparatus that provides means for identifying which plug is associated with which device.

Still a further object of the present invention is to provide a new and improved electrical plug protective apparatus that protects the plug from damage when not in use and from unauthorized use and can be easily installed or removed from an electrical plug protective device at the option of the user.

Yet another object of the present invention is to provide a new and improved electrical plug protective apparatus that can also be used with electrical cords having complementary male plugs and female sockets.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved electrical plug protective apparatus embodying the principles and concepts of the present invention will be described.

Figure 1:
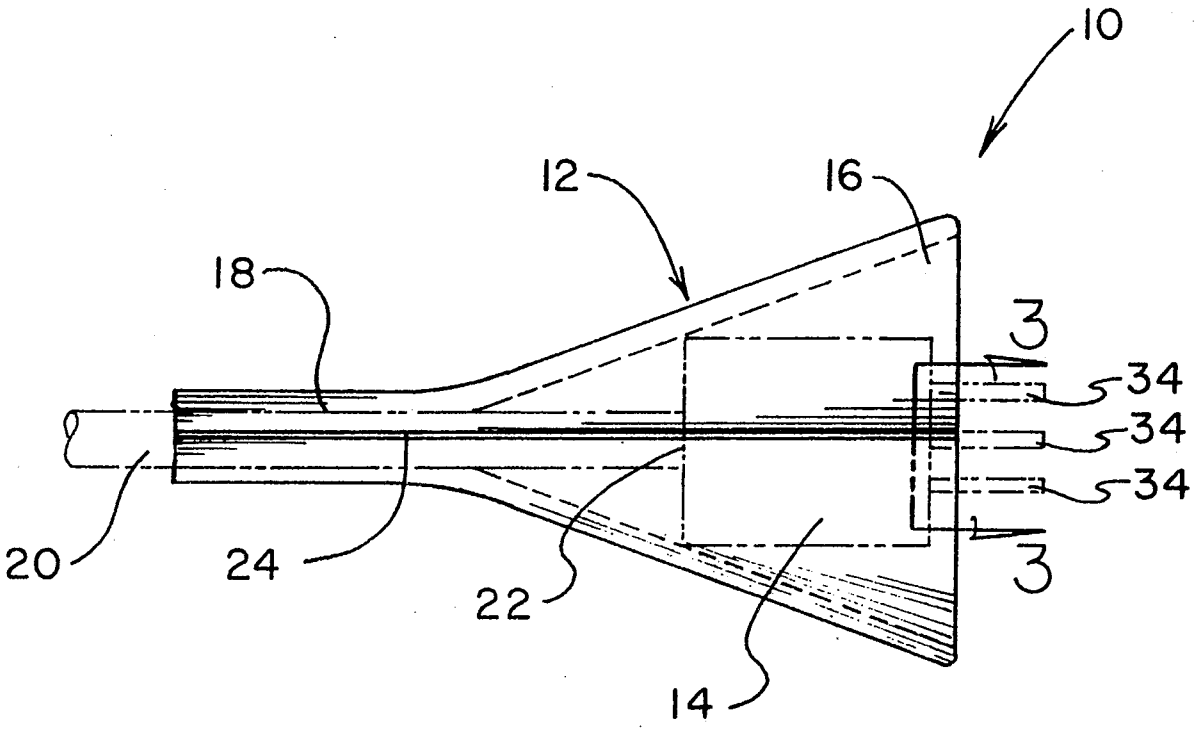
FIG. 1 is a side view showing a first preferred embodiment of the electrical plug protective apparatus of the invention with an electrical plug shown in phantom view.
Figure 2:
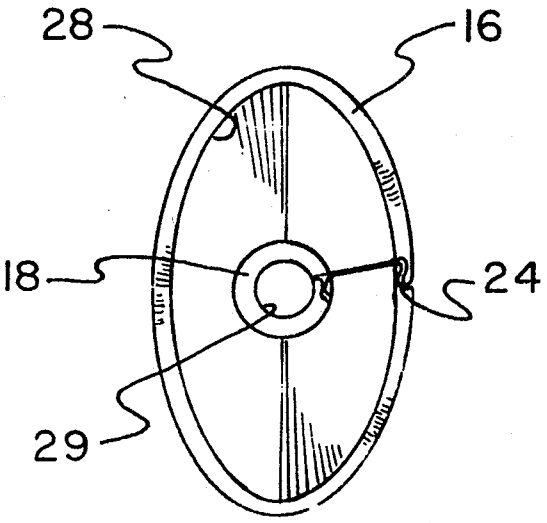
FIG. 2 is a front view of the electrical plug protective apparatus shown in FIG. 1.
Figure 3:
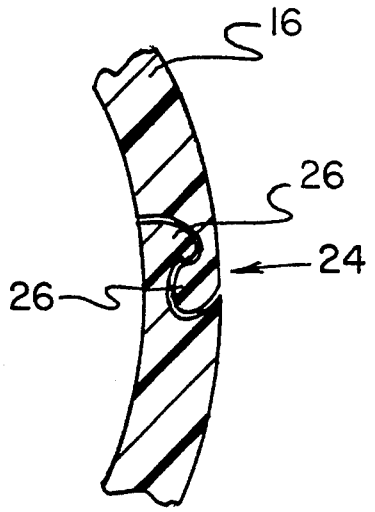
FIG. 3 is a cross-sectional view of the electrical plug protective apparatus of FIG. 1 taken along line 3—3 thereof.

Turning initially to FIGS. 1–3, there is shown a first exemplary embodiment of the electrical plug protective apparatus of the invention generally designated by reference numeral 10. The electrical plug protective apparatus 10 of the invention includes a first funnel-shaped protective member 12 for an electrical plug 14. The first funnel-shaped protective member 12 includes a cone-shaped portion 16 and a tubular portion 18 connected to the cone-shaped portion 16. The cone-shaped portion 16 protects the electrical plug 14, and the tubular portion 18 protects a region of a conductor 20 that is connected to a backside 22 of the electrical plug 14. The first funnel-shaped protective member 12 includes a separation assembly 24 which extends longitudinally along both the cone-shaped portion 16 and the tubular portion 18. The separation assembly 24 permits the first funnel-shaped protective member 12 to be opened for applying the first funnel-shaped protective member 12 to the electrical plug 14 and the conductor 20 or for removing the first funnel-shaped protective member 12 from the electrical plug 14 and the conductor 20.

As shown in greater detail in FIGS. 2 and 3, the separation assembly 24 includes complementary tongue and groove connectors 26 that snap together. In addition, a hinge assembly 40 is located on the first funnel-shaped protective member 12 in a location opposite to the complementary tongue and groove connectors 26. The hinge assembly 40 includes a living hinge.

The cone-shaped portion 16 of the first funnel-shaped protective member 12 includes a first aperture 28 at one end of the cone-shaped portion 16, and the tubular portion 18 includes a second aperture 29 at one end of the tubular portion 18.

Figure 4:
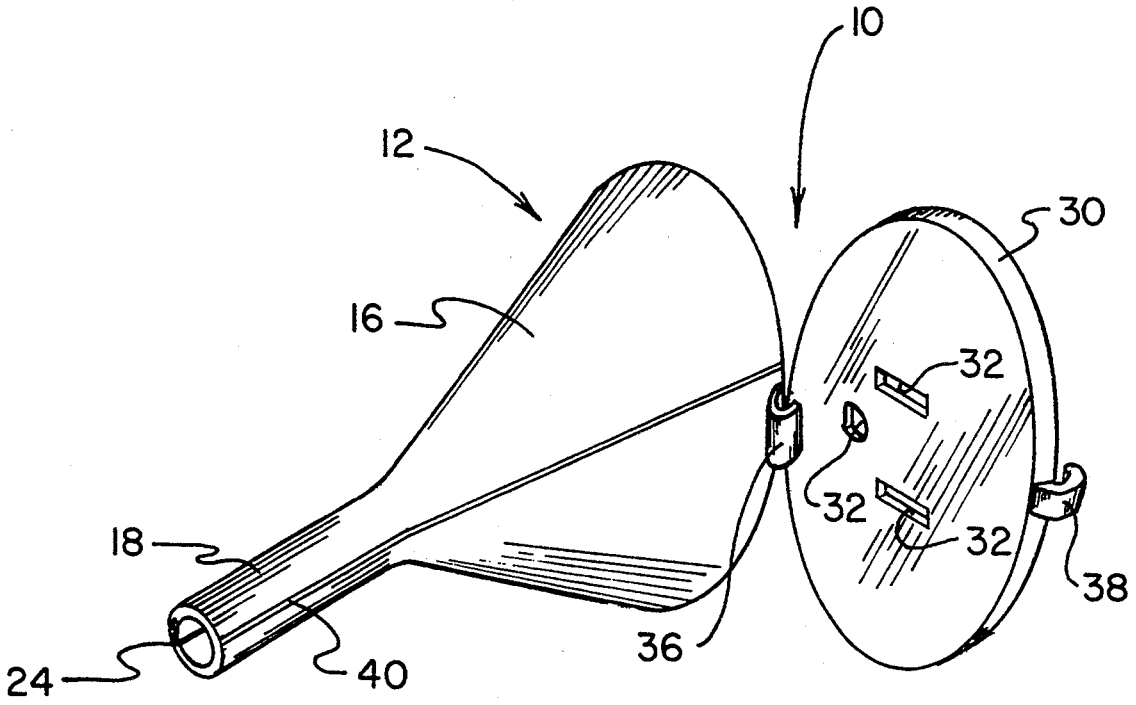
FIG. 4 is a rear perspective view of a second preferred embodiment of the electrical plug protective ,apparatus of the invention which includes a door for enclosing a plug within the electrical plug protective apparatus.

Turning to FIG. 4, a second embodiment of the invention is shown. Reference numerals are shown that correspond to like reference numerals that designate like elements shown in the other figures. In addition, a door 30 is provided for covering the first aperture 28 of the cone-shaped portion 16. The door 30 includes small apertures 32 for receiving prongs 34 of the electrical plug 14. The door 30 is attached to the cone-shaped portion 16 by a hinge 36 and a clip 38. The hinge 36 and the clip 38 project vertically to a side of the door 30.

Figure 5:
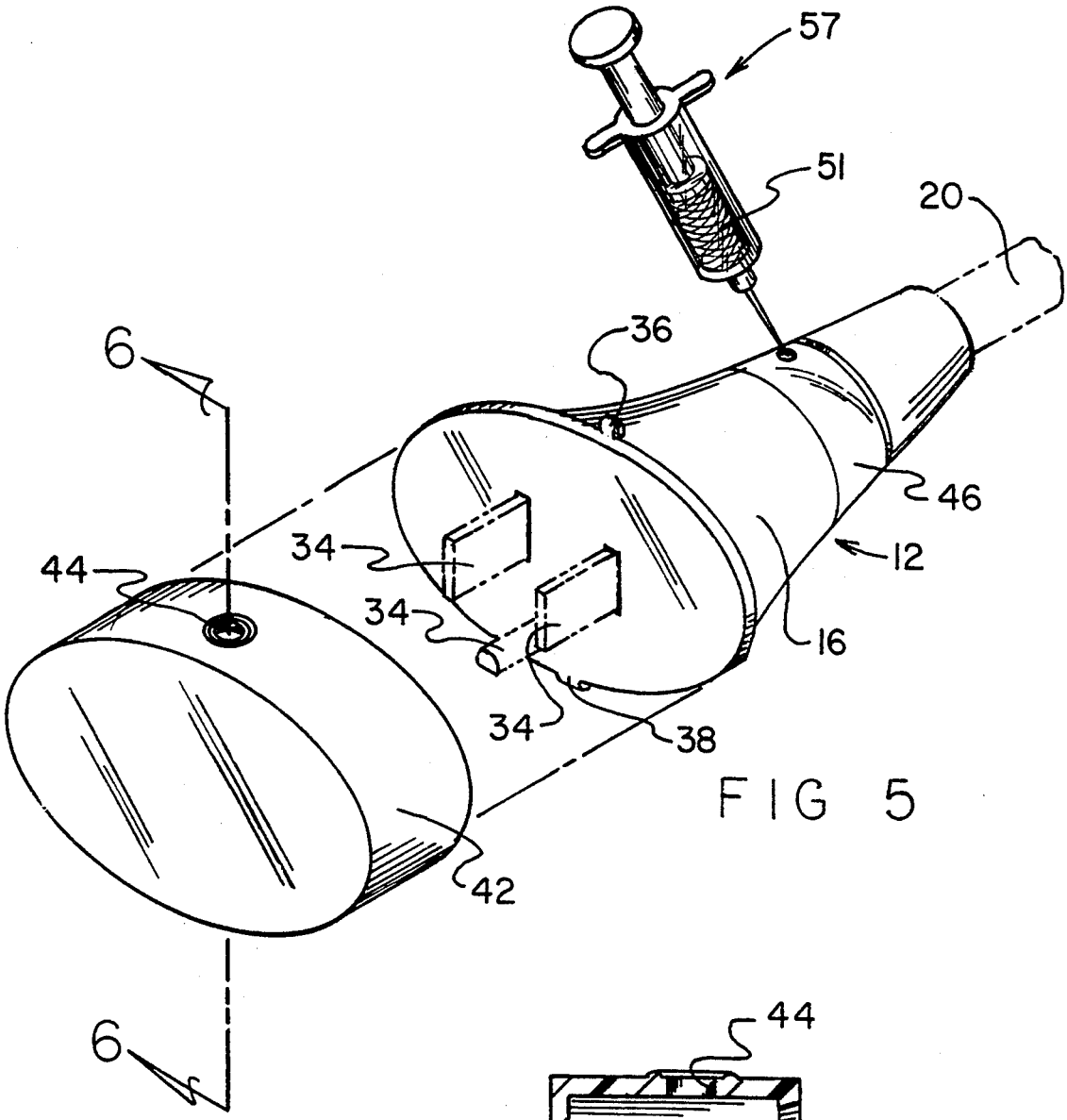
FIG. 5 is a partially exploded front perspective view of a third preferred embodiment of the electrical plug protective apparatus of the invention shown means for identifying an electrical plug and showing an add-on prong protector.
Figure 6:
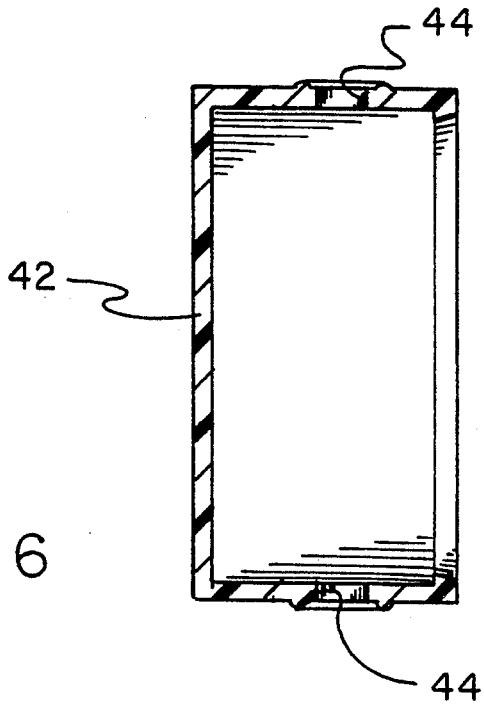
FIG. 6 is a cross-sectional view of the prong protector portion shown in FIG. 5 taken along the line 6—6 thereof.

Turning to FIGS. 5–6, a third embodiment of the invention is shown. Reference numerals are shown that correspond to like reference numerals that designate like elements shown in the other figures. In addition, a prong cover 42 is connected to the first funnel-shaped protective member 12 and covers the prongs 34 of the electrical plug 14. The prong cover 42 includes lock apertures 44 for receiving the hinge 36 and the clip 38 when the prong cover 42 is used to cover the prongs 34. In this way, the prong cover 42 is secured to the first funnel-shaped protective member 12.

As with reference to FIG. 5, the cone-shaped portion 16 includes a transparent window 46 permitting identification of an electrical plug 14 retained in the first funnel-shaped protective member 12. A quantity of colored plastic material 51 is injected by syringe 57 to within the cone-shaped portion 16 and is visible through the transparent window 46 permitting color-coded identification of an electrical plug 14 retained in the first funnel-shaped protective member 12. The plastic material 51 can harden to form a foam.

Figure 8:
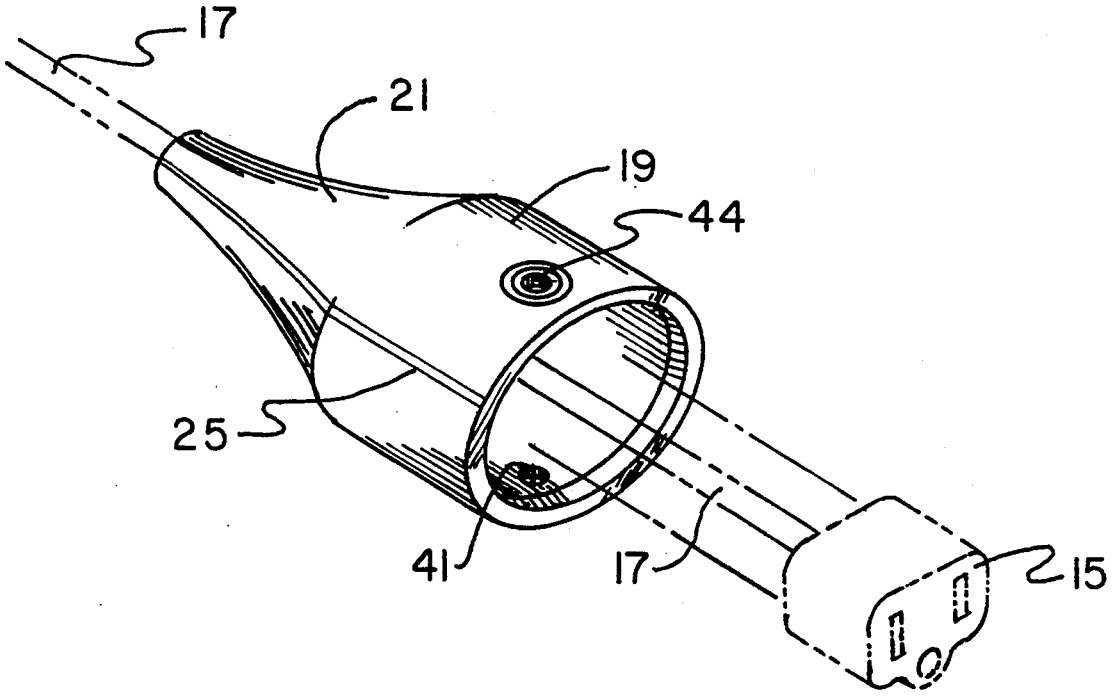
FIG. 8 is a partially exploded partial perspective view of a portion of the electrical plug protective apparatus of the invention shown in FIG. 7.
Figure 7:
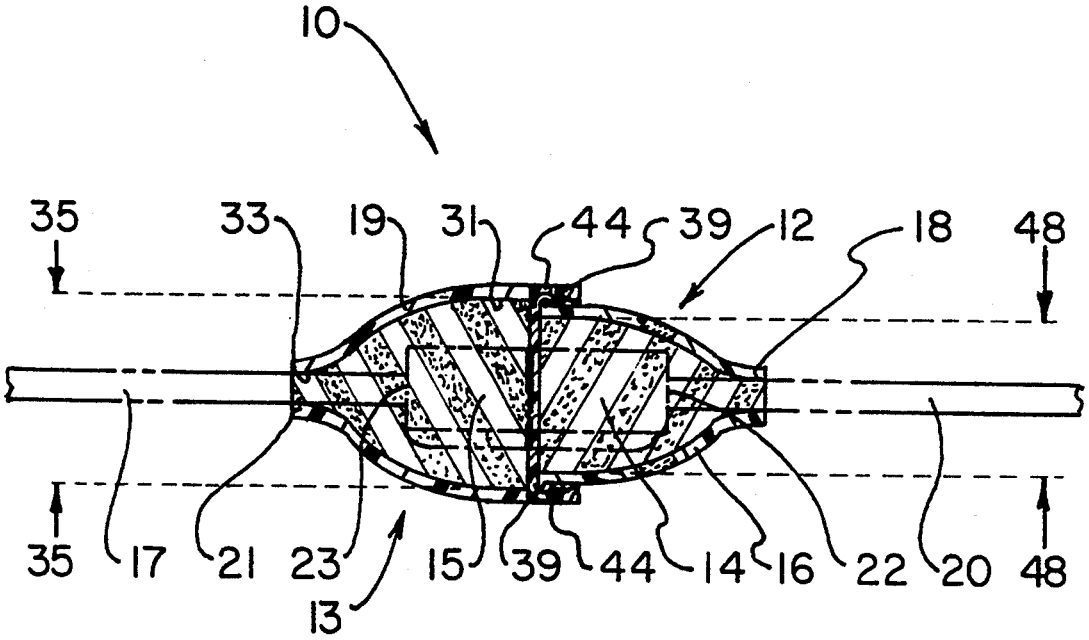
FIG. 7 is a side cross-sectional view of a fourth embodiment of the electrical plug protective apparatus of the invention showing use with a cord having a male plug and a complementary female socket.

Turning to FIGS. 7–8, a fourth embodiment of the invention is shown. Reference numerals are shown that correspond to like reference numerals that designate like elements shown in the other figures. In addition, the first aperture 28 of the cone-shaped portion 16 of the first funnel-shaped protective member 12 includes an inner diameter having an inner diameter length 48.

A second funnel-shaped protective member 13 is provided for an electrical socket 15 on a conductor 17. The second funnel-shaped protective member 13 includes a cone-shaped portion 19 and a tubular portion 21 connected to the cone-shaped portion 19. The cone-shaped portion 19 protects the electrical socket 15, and the tubular portion 21 protects a region of the conductor 17 that is connected to a backside 23 of the electrical socket 15. The second funnel-shaped protective member 13 includes separation assembly 25 extending longitudinally along both the cone-shaped portion 19 and the tubular portion 21, for permitting the second funnel-shaped protective member 13 to be opened and closed for protecting or removing the socket 15 from the second funnel-shaped protective member 13.

The cone-shaped portion 19 of the second funnel-shaped protective member 13 includes a first aperture 31 at one end of the cone-shaped portion 19. The tubular portion 21 includes a second aperture 33 at one end of the tubular portion 21. The first aperture 31 includes an inner diameter having an inner diameter length 35.

The inner diameter length 35 of the first aperture 31 of the second funnel-shaped protective member 13 is greater than the inner diameter length 48 of the first funnel-shaped protective member 12 such that the first funnel-shaped protective member 12 is nested into the second funnel-shaped protective member 13.

The first funnel-shaped protective member 12 and the second funnel-shaped protective member 13 include complimentary projections 39 and projection-receiving aperture connectors 41 for connecting the respective first and second funnel-shaped protective members together.

The components of the electrical plug protective apparatus of the invention can be made from inexpensive and durable molded plastic materials.

It is apparent from the above that the present invention accomplishes all of the objects set forth by providing a new and improved electrical plug protective apparatus that is low in cost, relatively simple in design and operation, and which may advantageously be used to give special protection to the region of the conductor that is connected to the backside of the plug. With the invention, the need for a separate protective portion for the female connector portion is precluded when the male connector portion is connected to the female connector portion. With the invention, an electrical plug protective apparatus is provided that can be used on an electrical plug when the plug is connected to a wall outlet. With the invention, and electrical plug protective apparatus is provided which protects an electrical plug without skewing the prongs of the plug. With the invention, an electrical plug is protected from damage when not in use and when preventing unauthorized use.

With the invention, an electrical plug protective apparatus is provided that is easy to install and that does not subject the plug to damage during installation. With the invention, an electrical plug protective device is provided that is easy to remove and place on another plug. With the invention, means are provided for identifying which plug is associated with which device. With the invention, a portion of an electrical plug protective apparatus that protects the plug from damage when not in use and from unauthorized use can be easily installed or removed from the electrical plug protective device at the option of the user. With the invention, respective applicable desirable features can also be used with cords having complementary male plugs and female sockets.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved electrical plug protective apparatus, comprising:

a first funnel-shaped protective member for an electrical plug, said first funnel-shaped protective member including a cone-shaped portion and a tubular portion connected to said cone-shaped portion, said cone-shaped portion for protecting the electrical plug, and said tubular portion for protecting a region of a conductor that is connected to a backside of the electrical plug, said first funnel-shaped protective member including separation assembly means, extending longitudinally along said cone-shaped portion and said tubular portion, for permitting said first funnel-shaped protective member to be opened for applying said first funnel-shaped protective member to the electrical plug and the conductor or for removing said first funnel-shaped protective member from the electrical plug and the conductor, further including:

a door for applying to said first aperture of said cone-shaped portion.

2. The apparatus described in claim 1 wherein said separation assembly means include:

complementary tongue and groove connectors.

3. The apparatus described in claim 1 wherein said separation assembly means include:

complementary tongue and groove connectors, and hinge assembly means located on said first funnel-shaped protective member in a location opposite to said complementary tongue and groove connectors.

4. The apparatus described in claim 3 wherein said hinge assembly means include a living hinge.

5. The apparatus described in claim 1 wherein:

said cone-shaped portion of said first funnel-shaped protective member includes a first aperture at one end of said cone-shaped portion, and said tubular portion includes a second aperture at one end of said tubular portion.

6. The apparatus described in claim 1 wherein said door includes small apertures for receiving prongs of the electrical plug.

7. The apparatus described in claim 1 wherein said door is attached to said cone-shaped portion by a hinge and a clip.

8. The apparatus described in claim 7 wherein said hinge and said clip project vertically to a side of said door.

9. A new and improved electrical plug protective apparatus, comprising:

a first funnel-shaped protective member for an electrical plug, said first funnel-shaped protective member including a cone-shaped portion and a tubular portion connected to said cone-shaped portion, said cone-shaped portion for protecting the electrical plug, and said tubular portion for protecting a region of a conductor that is connected to a backside of the electrical plug, said first funnel-shaped protective member including separation assembly means, extending longitudinally along said cone-shaped portion and said tubular portion, for permitting said first funnel-shaped protective member to be opened for applying said first funnel-shaped protective member to the electrical plug and the conductor or for removing said first funnel-shaped protective member from the electrical plug and the conductor, further including:

prong cover means, connected to said first funnel-shaped protective member, for covering prongs of the electrical plug.

10. The apparatus described in claim 9 wherein said prong cover means include locking means for receiving complementary locking means on said first funnel-shaped protective member when said prong cover means is used to cover the prongs, such that said prong cover means are secured to said first funnel-shaped protective member.

* * * * *